US009723397B2

(12) United States Patent
Nobouphasavanh

(10) Patent No.: US 9,723,397 B2
(45) Date of Patent: Aug. 1, 2017

(54) WIRELESS AUDIO ACCESSORY FOR ATTACHMENT TO AN ARTICLE OF CLOTHING

(71) Applicant: Four Seasons Design, Inc., San Diego, CA (US)

(72) Inventor: Nikh Nobouphasavanh, San Diego, CA (US)

(73) Assignee: Four Seasons Design, Inc., San Diego, CA (US)

( * ) Notice: Subject to any disclaimer, the term of this patent is extended or adjusted under 35 U.S.C. 154(b) by 0 days.

(21) Appl. No.: 14/984,735

(22) Filed: Dec. 30, 2015

(65) Prior Publication Data

US 2017/0127173 A1 May 4, 2017

Related U.S. Application Data

(60) Provisional application No. 62/247,538, filed on Oct. 28, 2015.

(51) Int. Cl.

| | |
|---|---|
| ***H04R 1/10*** | (2006.01) |
| ***A41F 1/00*** | (2006.01) |
| ***A45F 5/02*** | (2006.01) |

(52) U.S. Cl.

CPC ..... *H04R 1/1091* (2013.01); *A41F 1/002* (2013.01); *A45F 5/02* (2013.01); *H04R 1/1016* (2013.01); *H04R 1/1033* (2013.01); *H04R 1/1041* (2013.01); *H04R 2201/10* (2013.01); *H04R 2420/07* (2013.01)

(58) Field of Classification Search

CPC ..... H04R 1/10; H04R 1/1016; H04R 1/1033; H04R 1/1041; H04R 1/1091; H04R 5/0335; H04R 2201/10; H04R 2201/109; H04R 2201/023; H04R 2420/07; H04R 2201/103

See application file for complete search history.

(56) References Cited

U.S. PATENT DOCUMENTS

| | | | | |
|---|---|---|---|---|
| 2007/0248238 | A1* | 10/2007 | Abreu | G02C 3/003 381/381 |
| 2008/0144872 | A1* | 6/2008 | Phillips | H04R 5/0335 381/333 |
| 2011/0191941 | A1* | 8/2011 | Chiang | A42B 1/245 2/209.13 |

* cited by examiner

*Primary Examiner* — Mark Fischer

(74) *Attorney, Agent, or Firm* — George C. Rondeau, Jr.; Davis Wright Tremaine LLP

(57) ABSTRACT

A wireless audio accessory that is adapted to removably attach to an item of clothing or eyewear. The wireless audio accessory has an elongated, flexible main body with fasteners disposed along a length thereof. The fasteners comprise main body fasteners fixed to the main body and article fasteners adapted to attach to the item of clothing or eyewear. One or more sound generation units attached to the flexible main body are adapted to provide audio to a wearer of the wireless audio accessory. The wireless audio accessory includes a control unit that controls audio output aspects of the sound generation units. A short-range wireless receiver electronically coupled to the control unit receives short-range wireless signals and transmits audio signals to the sound generation units via the control unit.

19 Claims, 9 Drawing Sheets

WIRELESS AUDIO ACCESSORY FOR ATTACHMENT TO AN ARTICLE OF CLOTHING

CROSS-REFERENCE

This Application claims priority from U.S. Provisional Patent Application No. 62/247,538, filed Oct. 28, 2015, the entire contents of which are incorporated herein by reference.

FIELD OF INVENTION

The present invention relates to accessories having integrated electronics, the accessories being removably attachable to various items of clothing and headgear.

BACKGROUND

Wireless headphones currently available may receive wireless signals from a transmitting device, such as a cellular phone. However, many wireless headphones have straps or bands that are conspicuous. Eyeglasses or clothing may interfere with and jostle wireless headphones. Body movement may cause parts of the wireless headphones to snag on clothing or eyeglasses and thereby dislodge headphones from the ears. Control units on the wireless headphones may dangle from the headphones and annoy the headphone wearer by bouncing against the body or head while walking or exercising. Accordingly, there is a need for wireless headphones that inconspicuously couple with clothing or eyewear, that are easily accessible, and that do not interfere with articles of clothing, the body, or the head.

BRIEF DESCRIPTION OF THE DRAWINGS

Exemplary embodiments are illustrated in referenced figures. It is intended that the embodiments and figures disclosed herein are considered illustrative rather than restrictive.

DETAILED DESCRIPTION

Figure 1A:
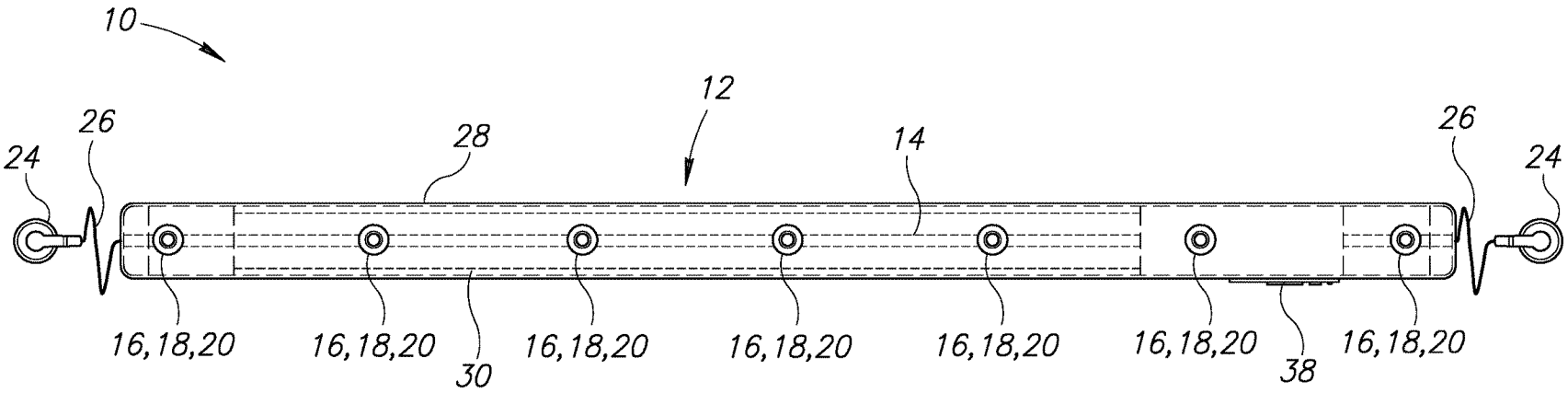
FIG. 1A illustrates a first side view of a wireless audio accessory.
Figure 1B:
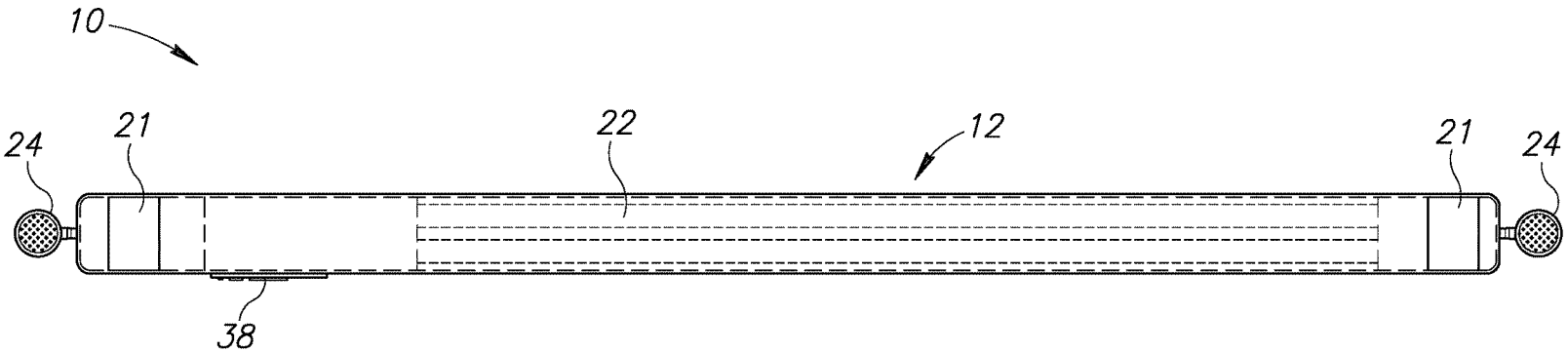
FIG. 1B illustrates a second side view of the wireless audio accessory of FIG. 1A.

A wireless audio accessory 10 in accordance with the present embodiment is shown in FIGS. 1A and 1B. The wireless audio accessory 10 has a flexible main body 12 with an elongated shape. The main body 12 may have a narrow or flat profile when viewed from the side. The flexible main body 12 may be comprised of a pliable textile that is comfortable when in contact with skin, such as microfiber, cotton, or polyester, by way of non-limiting example. The main body 12 has a first side 14 provided with fasteners 16 arranged along the length of the main body, and a second side 22 opposite the first side. Each of the fasteners 16 includes a main body fastener 18 permanently affixed to the main body 12, and an article fastener 20 that is removably attachable to a corresponding main body fastener. The article fasteners 20 may be configured to be secured to an article of clothing or headgear using an adhesive or fastener, as described in detail below. In the present embodiment, one of the main body fasteners 18 and the article fasteners 20 is a ferromagnetic component while the other one of the main body fasteners 18 and the article fasteners 20 is a component to which the ferromagnetic component is attracted. In some embodiments, the main body fasteners 18 and the article fasteners 20 may be complementary mechanically mating attachment components, such as snap fasteners or hook-and-loop fasteners.

Elastic receptacles 21 may be disposed near the ends of the main body 12, as shown in FIG. 1B. The elastic receptacles 21 are provided to stretch and allow insertion of eyewear temples therein, and tighten back against the main body 12 to secure the wireless audio accessory 10 to the eyewear (see FIG. 7). In the present embodiment, the elastic receptacles 21 are disposed on the second side 22 of the main body 12, but the elastic receptacles may be disposed on the first side 14 in other embodiments.

The wireless audio accessory 10 includes sound generation units 24 at opposite ends of the main body 12. In the present embodiment, the sound generation units 24 are headphones that may be positioned on or near a user's ears to provide audio input thereto. The sound generation units 24 are not particularly limited in type, and may be any of earbuds, on-ear headphones, or over-the-ear headphones, by way of non-limiting example. The sound generation units 24 may each have an ear hook that snuggly fits around the ear or a fin that snuggly fits an inner contour of the ear to secure the sound generation unit thereto. In some embodiments, the sound generation units 24 may be an audio speaker 25 that is disposed on or affixed to the main body 12 (see FIG. 8). The audio speaker 25 may be small yet powerful enough to project sound to the wearer of the wireless audio accessory 10 and other persons close to the wearer.

Figure 8:
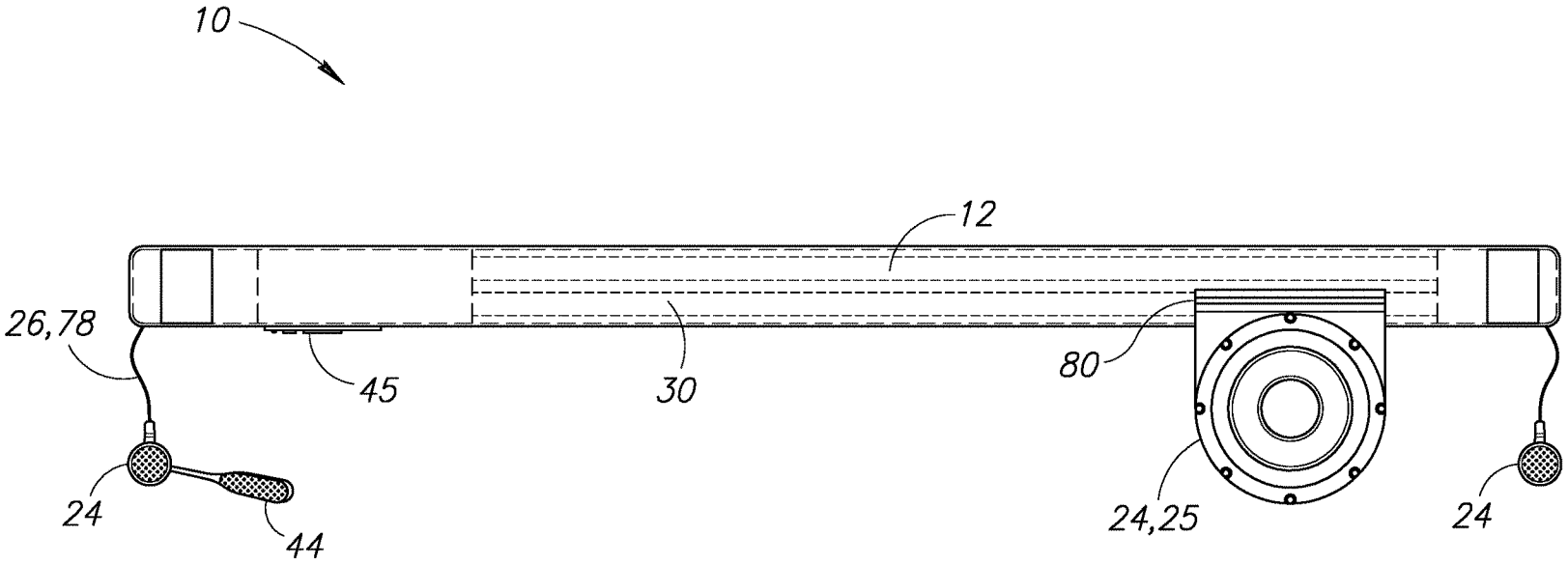
FIG. 8 illustrates the first side view of the wireless audio accessory of FIG. 1A according to a second embodiment.

Cables 26 extend from openings on the opposing ends of the main body 12 to connect each sound generation units 24 to the main body. The cables 26 may be signal conducting electric wires. In some embodiments, the cables 26 may instead extend from openings on a top side 28 or a bottom side 30 of the main body 12, as shown in FIG. 8. A control panel 38 is exposed along the bottom side 30 of the main body 12 to facilitate user control of various aspects of the wireless audio accessory 10, as described below.

Figure 2:
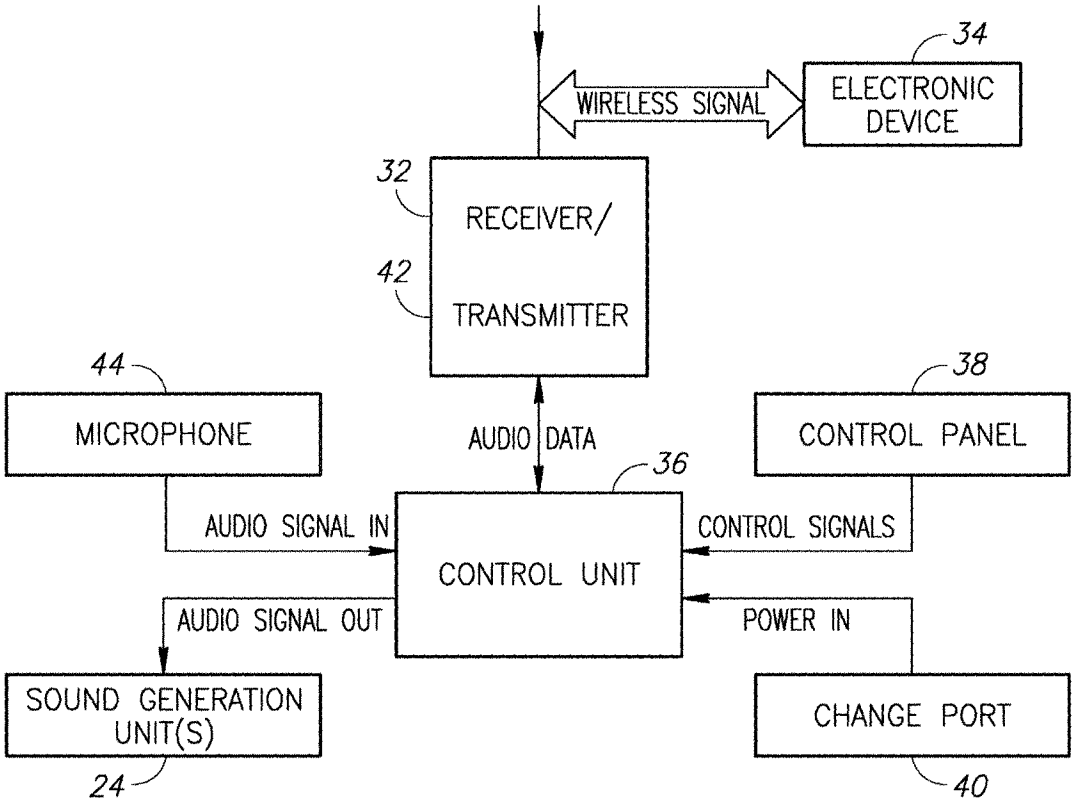
FIG. 2 illustrates a schematic view of electronic components of the wireless audio accessory of FIG. 1A.

The wireless audio accessory 10 is provided with a short-range wireless receiver 32 for receiving and processing short-range signals from an electronic device 34, as shown in FIG. 2. The wireless receiver 32 may include one or more of a Bluetooth receiver, an IrDA receiver, a ZigBee receiver, a RuBee receiver, a Near Field Communication receiver, or other similar short-range wireless receiver. In other embodiments, the wireless receiver 32 may include a medium-range wireless receiver, such as a Wi-Fi receiver configured to receive and process Wi-Fi data signals from a Wi-Fi transmitter. The wireless receiver 32 produces an audio signal from the received signal and sends the audio signal to a control unit 36. The control unit 36 may further process the audio signal to produce and send an audio output signal to one or more of the sound generation units 24. A control panel 38 has one or more buttons, rocker switches, wheels, or other interface mechanisms for facilitating a user to control various aspects of the wireless audio accessory 10, as described below in greater detail. A charging port 40 on the wireless audio accessory 10 is provided for charging a battery that powers the electronic components of the wireless audio accessory, such as the control unit 36, the sound generation unit(s) 24, and/or the wireless receiver 32.

In some embodiments, the wireless audio accessory 10 is provided with a short-range wireless transmitter 42 for sending short-range wireless signals to the electronic device 34. The wireless transmitter 42 may include one or more of a Bluetooth transmitter, an IrDA transmitter, a ZigBee transmitter, a RuBee transmitter, a Near Field Communication transmitter, or other similar short-range wireless transmitter. In some embodiments, the wireless transmitter 42 may include a medium-range wireless transmitter, such as a Wi-Fi transmitter configured to transmit Wi-Fi data signals to a Wi-Fi receiver. In some embodiments, the wireless audio accessory 10 includes a microphone 44 (see FIG. 8) that produces electrical audio signals that are transmitted from the transmitter 42 to a paired electronic device 34.

Figure 3A:
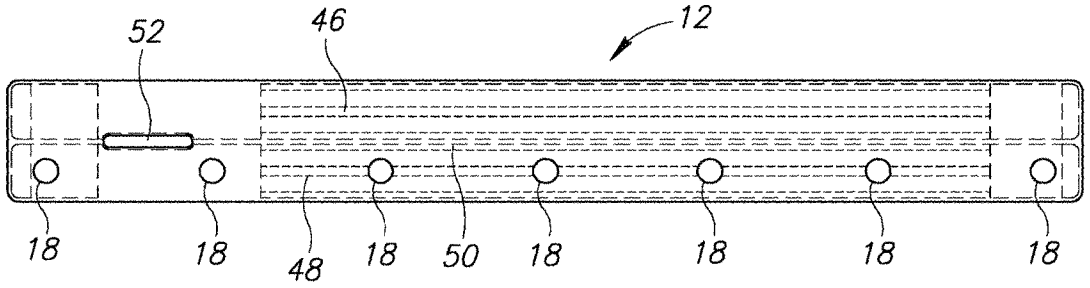
FIG. 3A illustrates a plan view of the wireless audio accessory of FIG. 1A in an opened configuration without audio components installed.

An inner cavity of the main body 12 is defined by a first sidewall 46 and a second sidewall 48 extending in parallel along a spine 50, as shown in FIG. 3A. The main body fasteners 18 are fixed to the first sidewall 46 at intervals along the length of the main body 12. The attachment portions of the main body fasteners 18, such as a magnetic component or a male/female portion of a snap fastener, should face the first sidewall 46. The first side 14 may be provided with apertures sized and shaped to allow access to attachment portions of the fasteners from the first side 14. The main body 12 includes an aperture 52 for allowing access to the control panel 38 when the control unit 36 is enclosed in the main body. The aperture 52 may be located closer to one end of the main body 12 to position the control panel 38 along a side of the user's head for easy control panel access when the wireless audio accessory 10 is attached to eyewear or headgear.

Figure 3B:
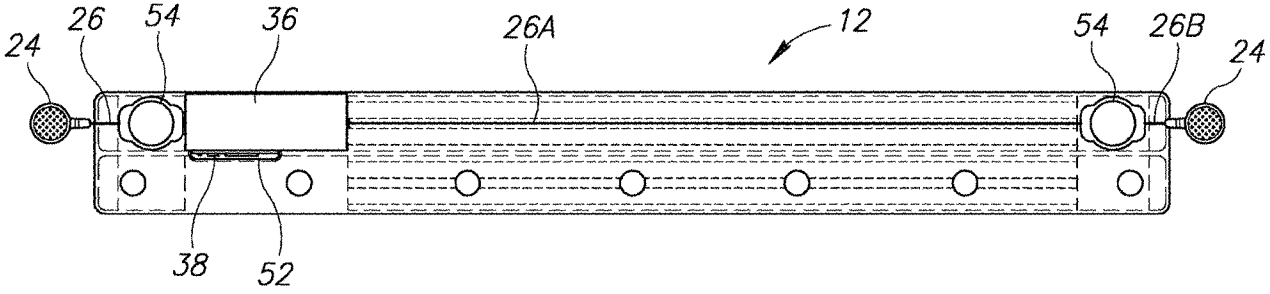
FIG. 3B illustrates a plan view of the wireless audio accessory of FIG. 1A in an opened configuration with audio components installed.

The main body 12 may be configured to allow the first sidewall 46 and the second sidewall 48 to be selectively fastened to and separated from each other. In some embodiments, the first sidewall 46 and the second sidewall 48 may have opposing strips of hook-and-loop fasteners that form a bond between the strips when pressed together. In other embodiments, opposing zipper portions may extend along a periphery of the main body 12 that selectively secure the first sidewall 46 and the second sidewall 48 together when the opposing zipper portions are engaged. When the first sidewall 46 and the second sidewall 48 are separated, as shown in FIGS. 3A and 3B, the internal components (e.g., the control unit 36, sound generation units 24) may be removed from the wireless audio accessory 10 to allow the main body 12 to be cleaned without damaging sensitive electronic and/or mechanical components. After cleaning the main body 12, the internal components may be reinstalled in the main body and the first sidewall 46 and the second sidewall 48 may be refastened together.

The control unit 36 is positioned along the first sidewall 46 or second sidewall 48 with the control panel 38 facing toward the aperture 52, as shown in FIG. 3B. The cables 26 extend from opposite sides of the control unit 36 and form an electrical connection between the control unit and the sound generation units 24. The wireless audio accessory 10 may include cable retractors 54 that are operable to selectively extend or retract a length of the cable 26 between the sound generation units 24 and the control unit 36. The cables 26 may include a fixed length portion 26A between the control unit 36 and the cable retractors 54 to position the cable retractors 54 near ends of the main body 12. The cable retractors 54 are operable to adjust a length of variable length portions 26B of the cables 26 between the cable retractors and the sound generation units 24. The cable retractors 54 may be equipped with a button or switch to retract the variable length portion 26B.

Figure 4:
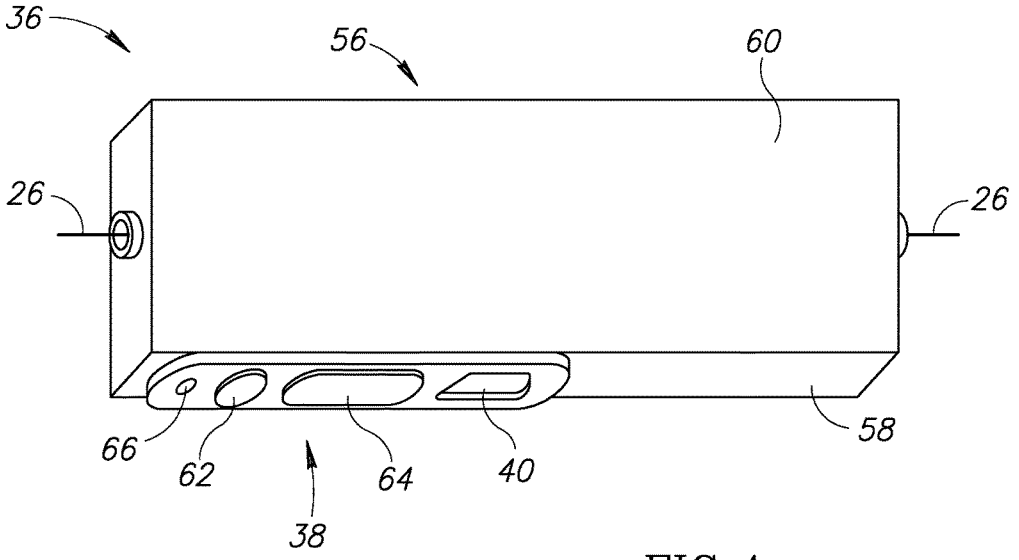
FIG. 4 illustrates a perspective view of a control unit of the wireless audio accessory of FIG. 1A.

A body 56 of the control unit 36 has narrow sides 58 that are narrow in a depth direction, giving the main body 12 a low profile, as shown in FIG. 4. A soft material may cover major sides 60 of the body 56 and elastically deform when the main body 12 is snuggly fitted against the user to promote comfort. The control panel 38 located on one of the narrow sides 58 may include several control elements for controlling the audio input/output of the wireless audio accessory 10. A power on/off switch 62 transitions the wireless audio accessory 10 between a powered state and an unpowered state. A multi-control button 64 may adjust various aspects of the wireless audio accessory 10 including volume, pausing/playing the current track, and skipping to the next/previous track. When the wireless audio accessory 10 is equipped with the microphone 44, the multi-function control 64 may be operable to answer, hang-up, and/or ignore incoming phone calls on a connected electronic device 34. The multi-function control 64 may be implemented using one or more buttons, rockers, or switches that send electronic control signals to the control unit 36. An LED 66 provides status indications regarding states of the wireless audio accessory 10, including whether the device is in the powered or unpowered state, whether the device battery is low on power, and whether the device battery is fully charged. Instead of the LED 66, a small LCD/LED screen may be provided on the control panel 38 for providing status indications. The charging port 40 on the control panel 38 is a receptacle (e.g., micro-USB) for receiving a connector configured to power the device battery.

Figure 5A:
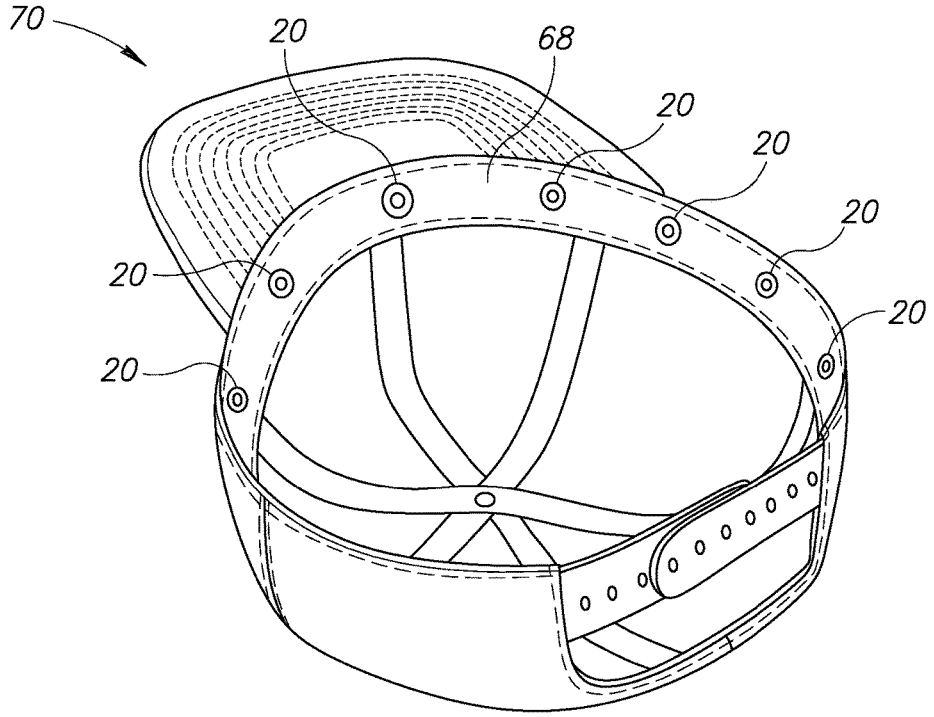
FIG. 5A illustrates a perspective view of clothing fasteners of the wireless audio accessory of FIG. 1A installed in headgear.
Figure 5B:
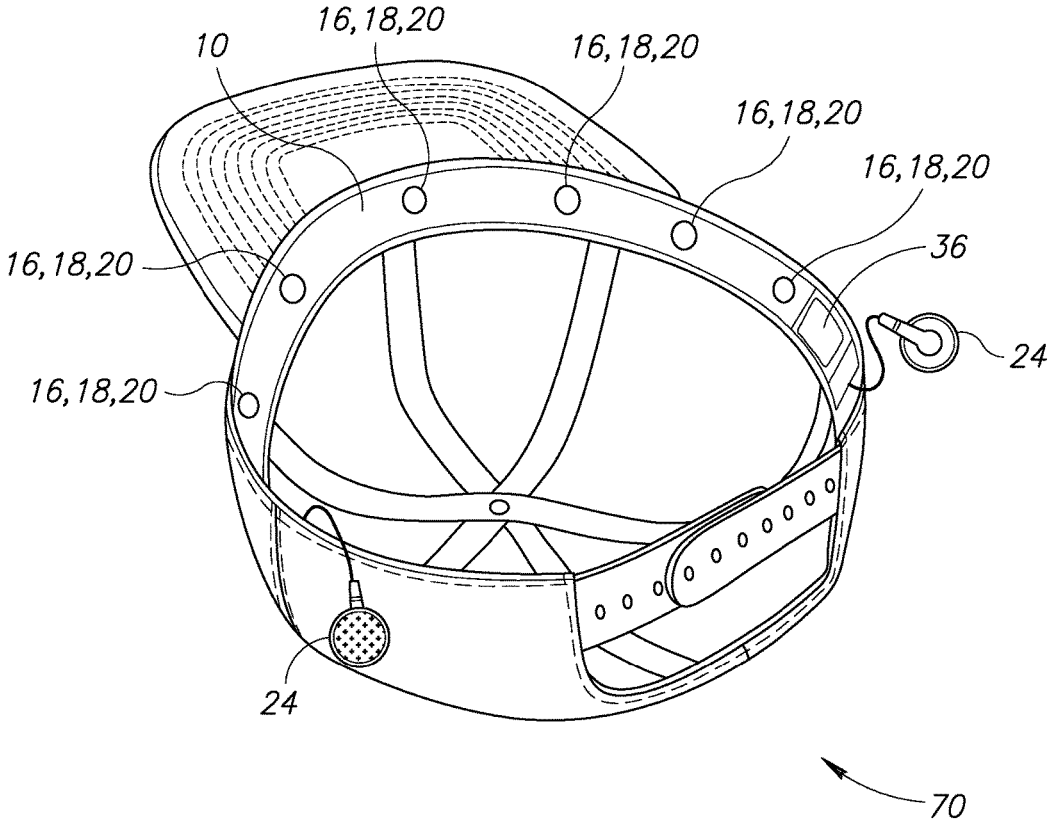
FIG. 5B illustrates a perspective view of the wireless audio accessory of FIG. 1A attached to the headgear of FIG. 5A.

The article fasteners 20 may be secured to an inner sweatband portion 68 of headgear 70, as shown in FIG. 5A. Backs of the article fasteners 20 may be equipped with an adhesive or a clasp configured to securely attach to the sweatband portion 68. In some embodiments, the article fasteners 20 may be fixed to an attachment belt that fits over and interlocks with the sweatband portion 68. In other embodiments, the headgear 70 may be produced with the article fasteners 20 directly and permanently fixed to the sweatband portion 68. To secure the main body 12 to the headgear, each of the main body fasteners 18 engage with a correspondingly positioned one of the article fasteners 20 attached to the headgear 70, as shown in FIG. 5B. Once attached to the headgear 70, the sound generation units 24 may be inserted into the ears.

Figure 6A:
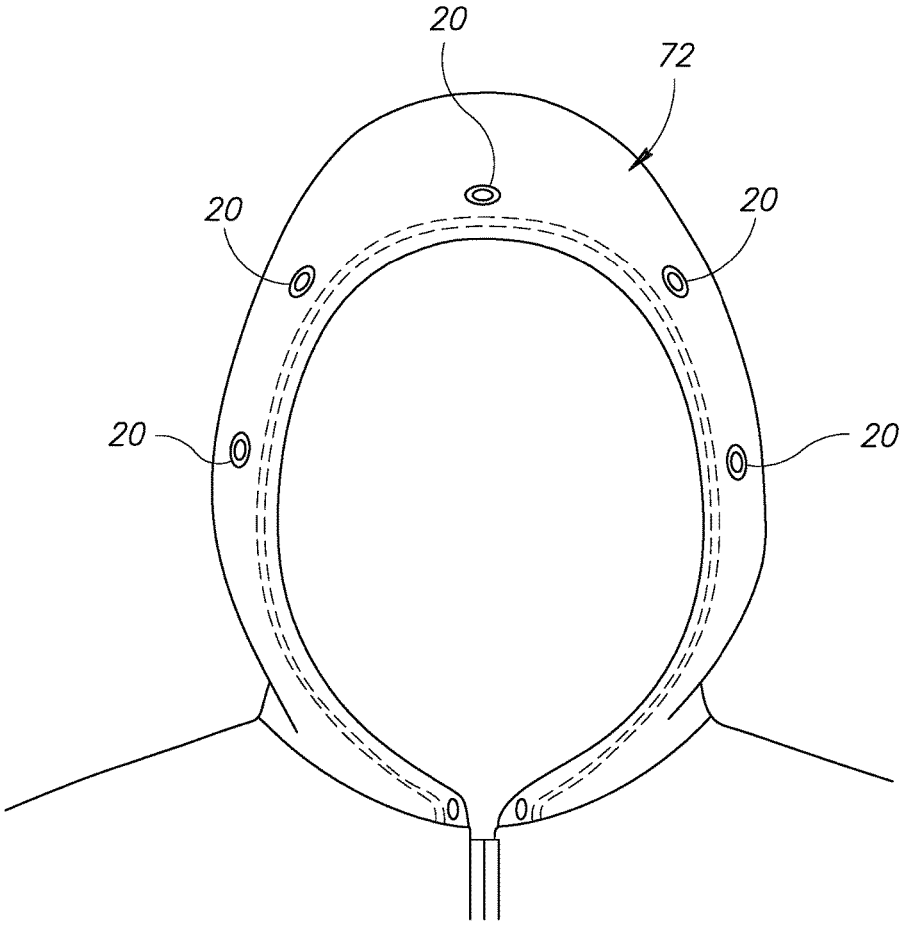
FIG. 6A illustrates a perspective view of clothing fasteners of the wireless audio accessory of FIG. 1A installed in an article of clothing.
Figure 6B:
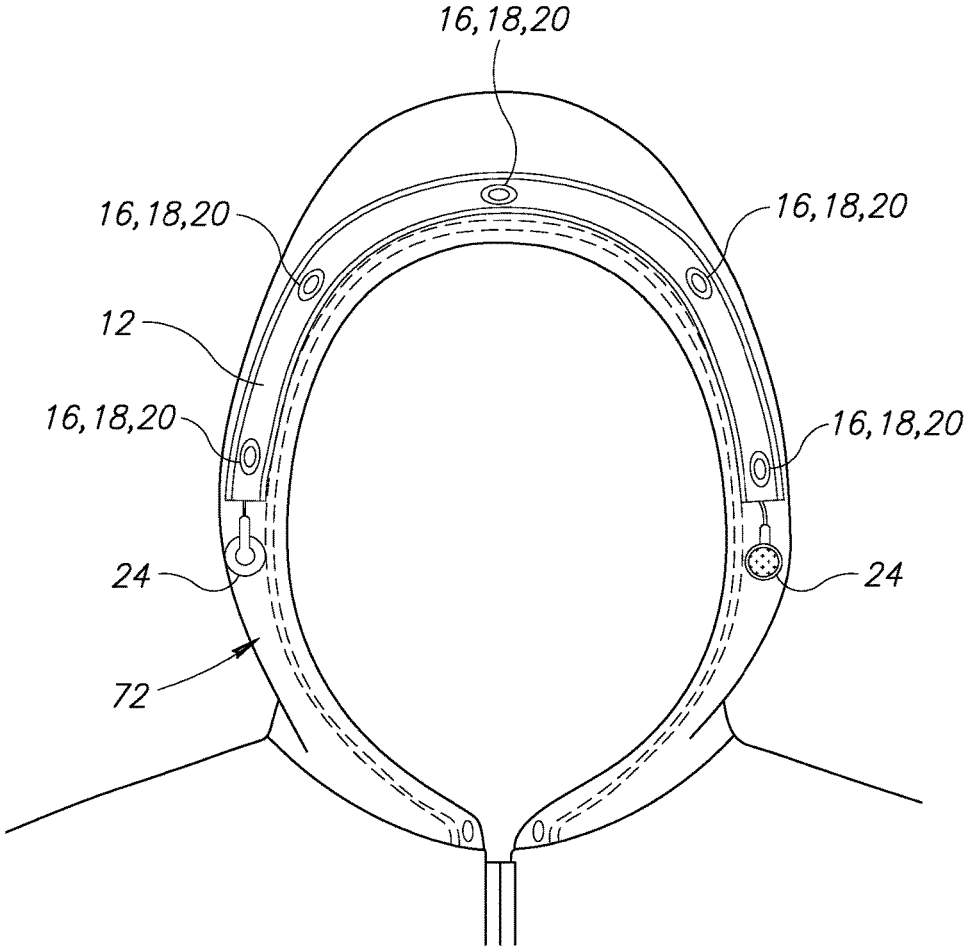
FIG. 6B illustrates a perspective view of the wireless audio accessory of FIG. 1A attached to the article of clothing of FIG. 6A.

The wireless audio accessory 10 is configured to attach to other articles of headgear, such as a hood in a jacket or sweatshirt. For example, the article fasteners 20 may be attached to the inner rim of a hood 72, as shown in FIG. 6A. The main body fasteners 18 of the fasteners 16 may then be attached to correspondingly positioned ones of the article fasteners 20 to secure the wireless audio accessory 10 to the hood, as shown in FIG. 6B. The wireless audio accessory may attach to other articles of clothing, such as a headband or a collar of a shirt.

Figure 7:
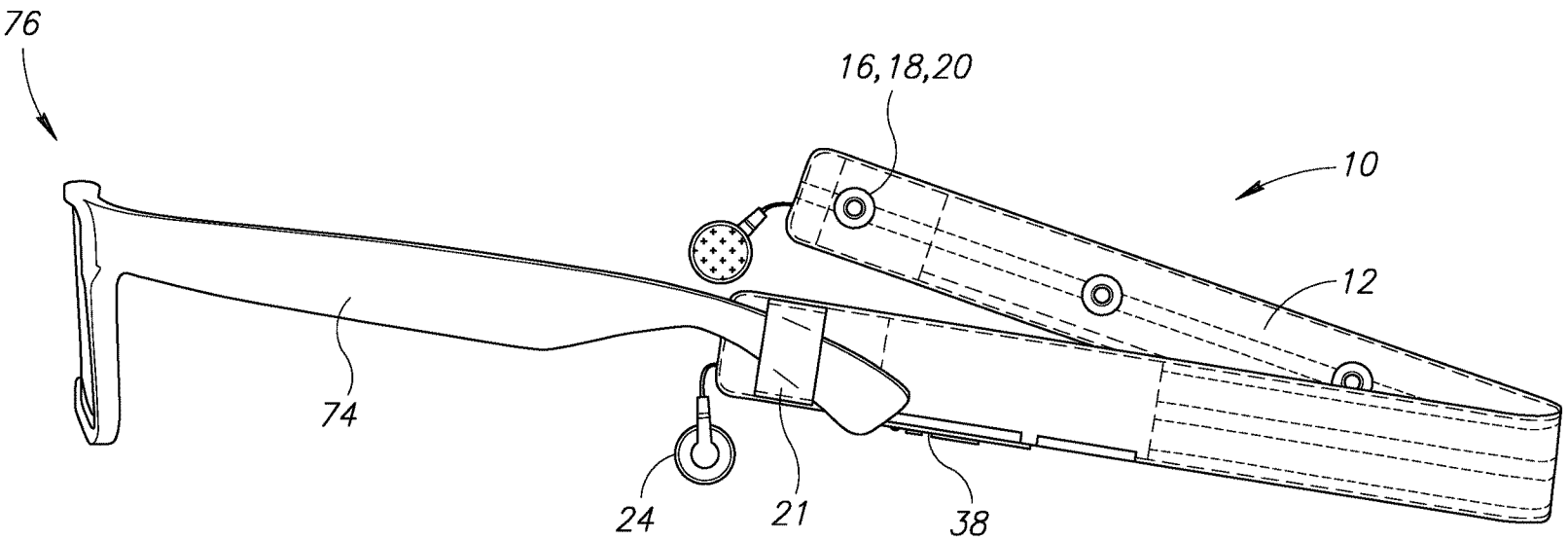
FIG. 7 illustrates a side view of the wireless audio accessory of FIG. 1A attached to eyewear.

The wireless audio accessory 10 may be attached to temples 74 of eyewear 76, as shown in FIG. 7. In particular, the temples 74 may be inserted into the elastic receptacles 21, which slightly flex to accommodate the temples. In the present embodiment, the elastic receptacles 21 are bands through which the temples 74 may extend. In other embodiments, the elastic receptacles 21 are pockets that completely enclose ends of the temples 74. When the wireless audio accessory 10 is attached to the eyewear 76, the sound generation units 24 are conveniently located at a user's ear for easy insertion therein and removal therefrom.

Those of ordinary skill in the art will appreciate that additions or modifications to the above-described embodiments of the wireless audio accessory 10 may be made without departing from the scope of the disclosure. The microphone 44 may be attached to or be integrated with one or both of the sound generation units 24, as shown in FIG. 8. Alternatively, a microphone 45 may be disposed on the control unit 36. The cables 26 may extend from the bottom side 30 of the main body 12 instead of from end portions of the main body. A bendable, semi-rigid sheath 78 may be arranged around a lengthwise portion of the cables 26. The bendable, semi-rigid sheath 78 is a self-supporting member whose shape may be adjusted and independently held in place to move and retain the sound generation units 24 in a desired position relative to the main body 12. Similarly, the audio speaker 25 may be affixed to the main body 12 via a bendable, semi-rigid connector 80 that is a self-supporting member adapted to orient and hold the audio speaker in different positions relative to the main body.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedia components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

What is claimed is:

1. A clothing accessory for removable attachment to an item of clothing, comprising:

a flexible main body having an elongated shape that includes a first sidewall and a second sidewall opposing the first sidewall, a narrow spine portion connecting the first sidewall and the second sidewall, and an aperture located along the spine portion;

a plurality of main body fasteners fixedly attached to the flexible main body;

a plurality of clothing fasteners configured to attach to the item of clothing;

a wireless receiver configured to receive short-range wireless signals;

a first sound generation unit; and a control unit attached to the flexible main body and electronically coupled to the wireless receiver and the first sound generation unit, the control unit having a control panel positioned along a narrow side portion of the control unit and the control unit being configured to control transmission of audio signals between the first sound generation unit and the wireless receiver, the main body fasteners and the clothing fasteners being configured to couple together and removably secure the flexible main body to the item of clothing, the first sidewall having a first attachment portion and the second sidewall having a second attachment portion, the second attachment portion configured to selectively attach to the first attachment portion to form an interior cavity defined by the first sidewall and the second sidewall, the interior cavity sized and shaped to removably secure the control unit within the flexible main body, and the control unit being adapted to be positioned at the aperture such that the control panel is exposed at the aperture when the control unit is secured within the flexible main body.

2. The clothing accessory of claim 1 wherein the flexible main body has an elongated shape, the clothing fasteners being configured to attach along an inner surface of the item of clothing such that the flexible main body extends along the inner surface when the main body fasteners are attached to the clothing fasteners.

3. The item of clothing of claim 1 wherein the flexible main body has an elongated shape including first and second exterior faces disposed on opposite side faces of the flexible main body, and wherein attachment surfaces of the main body fasteners are exposed along the first exterior face.

4. The item of clothing of claim 1 wherein the main body fasteners and the clothing fasteners include magnetic components that form a secure magnetic connection between the main body fasteners and the clothing fasteners to removably secure the flexible main body to the item of clothing.

5. The clothing accessory of claim 1 wherein the flexible main body has first and second end portions at opposite ends of a length of the flexible main body, and the first sound generation unit is attached to the flexible main body at the first end portion.

6. The clothing accessory of claim 1, further comprising a second sound generation unit attached to the flexible main unit, the second sound generation unit being electronically coupled to the control unit.

7. The clothing accessory of claim 6 wherein the flexible main body has first and second end portions at opposite ends of a length of the flexible main body, the first sound generation unit is attached to the flexible main body at the first end portion, and the second sound generation unit is attached to the flexible main body at the second end portion.

8. The clothing accessory of claim 1 wherein one or more control buttons are disposed on the control panel, and the one or more controls buttons are accessible through the aperture when the control unit is secured within the flexible main body.

9. The clothing accessory of claim 1, further comprising a cable retraction unit and a cable connecting the first sound generation unit to the control unit, the cable retraction unit being configured to selectively extend and retract a length of the cable between the first sound generation unit and the control unit.

10. The clothing accessory of claim 1, further comprising:

a sound input device attached to the flexible main body and configured to generate audio input signals; and a wireless transmitter configured to transmit short-range signals including information based on the audio input signals.

11. An eyewear accessory for removable attachment to an item of eyewear, comprising:

a flexible main body having an elongated shape including first and second exterior faces disposed on opposite planar surfaces of the flexible main body, the flexible main body having a first sidewall and a second sidewall opposing the first sidewall, a narrow spine portion connecting the first exterior face and the second exterior face, and an aperture located along the spine portion;

a wireless receiver configured to receive short-range wireless signals;

a first sound generation unit;

a control unit attached to the flexible main body and electronically coupled to the wireless receiver and the first sound generation unit, the control unit having a control panel positioned along a narrow side portion of the control unit and the control unit being configured to control transmission of audio signals between the first sound generation unit and the wireless receiver; and a first elastic receptacle and a second elastic receptacle disposed on the first exterior face of the flexible main body, the first elastic receptacle and the second elastic receptacle being configured to flexibly receive and retain first and second temples of the item of eyewear, the first sidewall having a first attachment portion and the second sidewall having a second attachment portion, the second attachment portion configured to selectively attach to the first attachment portion to form an interior cavity defined by the first sidewall and the second sidewall, the interior cavity sized and shaped to removably secure the control unit within the flexible main body, and the control unit being adapted to be positioned at the aperture such that the control panel is exposed at the aperture when the control unit is secured within the flexible main body.

12. The eyewear accessory of claim 11 wherein the flexible main body has first and second end portions at opposite ends of a length of the flexible main body, the first elastic receptacle is disposed at the first end portion, and the second elastic receptacle is disposed at the second end portion.

13. The eyewear accessory of claim 12 wherein the first sound generation unit is attached to the first end portion.

14. The eyewear accessory of claim 12, further comprising a second sound generation unit attached to the second end portion, wherein the second sound generation unit is electronically coupled to the control unit.

15. The eyewear accessory of claim 12, further comprising:

a sound input device attached to the flexible main body and configured to generate audio input signals; and a wireless transmitter configured to transmit short-range signals including information based on the audio input signals.

16. The eyewear accessory of claim 11, further comprising a second sound generation unit attached to the flexible main unit, wherein the second sound generation unit is electronically coupled to the control unit.

17. The eyewear accessory of claim 11 wherein one or more control buttons are disposed on the control panel, and the one or more controls buttons are accessible through the aperture when the control unit is secured within the flexible main body.

18. The eyewear accessory of claim 11, further comprising a cable retraction unit and a cable connecting the first sound generation unit to the control unit, the cable retraction unit being configured to selectively extend and retract a length of the cable between the first sound generation unit and the control unit.

19. A clothing accessory for removable attachment to an item of clothing having clothing fasteners, comprising:

a flexible main body having an elongated shape including first and second exterior faces disposed on opposite planar faces of the flexible main body, the flexible main body having a first sidewall and a second sidewall opposing the first sidewall, a narrow spine portion connecting the first exterior face and the second exterior face, and an aperture located along the spine portion;

a first elastic receptacle and a second elastic receptacle disposed on the first exterior face of the flexible main body, the first elastic receptacle and the second elastic receptacle being configured to flexibly receive and retain first and second temples of an item of eyewear;

a plurality of main body fasteners configured to couple with the clothing fasteners to removably secure the flexible main body to the item of clothing;

a wireless receiver configured to receive short-range wireless signals;

a sound generation unit; and a control unit attached to the flexible main body and electronically coupled to the wireless receiver and the sound generation unit, the control unit having a control panel positioned along a narrow side portion of the control unit and the control unit being configured to control transmission of audio signals between the sound generation unit and the wireless receiver, the first sidewall having a first attachment portion and the second sidewall having a second attachment portion, the second attachment portion configured to selectively attach to the first attachment portion to form an interior cavity defined by the first sidewall and the second sidewall, the interior cavity sized and shaped to removably secure the control unit within the flexible main body, and the control unit being adapted to be positioned at the aperture such that the control panel is exposed at the aperture when the control unit is secured within the flexible main body.

* * * * *